US010563465B2

(12) United States Patent
Tinsley et al.

(10) Patent No.: US 10,563,465 B2
(45) **Date of Patent: *Feb. 18, 2020**

(54) DOWNHOLE VIBRATORY TOOL FOR PLACEMENT IN DRILLSTRINGS

(71) Applicant: Russell W. Earles, Sr., Lafayette, LA (US)

(72) Inventors: Doug Tinsley, Houston, TX (US); Richard Allan Moore, New Iberia, LA (US)

(73) Assignee: Russell W. Earles, Sr., Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/028,912

(22) Filed: Jul. 6, 2018

(65) Prior Publication Data

US 2018/0313164 A1 Nov. 1, 2018

Related U.S. Application Data

(63) Continuation of application No. 14/814,710, filed on Jul. 31, 2015, now Pat. No. 10,017,999.

(60) Provisional application No. 62/111,348, filed on Feb. 3, 2015, provisional application No. 62/033,352, filed on Aug. 5, 2014.

(51) Int. Cl.

| | |
|---|---|
| ***E21B 12/00*** | (2006.01) |
| ***E21B 7/04*** | (2006.01) |
| ***E21B 3/00*** | (2006.01) |
| ***E21B 17/22*** | (2006.01) |

(52) U.S. Cl.
CPC ..... *E21B 12/00* (2013.01); *E21B 3/00* (2013.01); *E21B 7/046* (2013.01); *E21B 17/22* (2013.01)

(58) Field of Classification Search
CPC . E21B 12/00; E21B 3/00; E21B 7/046; E21B 17/22
See application file for complete search history.

(56) References Cited

U.S. PATENT DOCUMENTS

| | | | | |
|---|---|---|---|---|
| 2,752,861 A * | 7/1956 | Hill | E21B 34/14 | 166/106 |
| 5,894,896 A * | 4/1999 | Smith | E21B 7/06 | 175/322 |
| 6,074,784 A * | 6/2000 | Maruta | H01M 4/525 | 429/223 |
| 6,092,610 A * | 7/2000 | Kosmala | E21B 4/20 | 175/27 |
| 6,202,762 B1 * | 3/2001 | Fehr | E21B 4/02 | 175/107 |

(Continued)

*Primary Examiner* — Yong-suk Ro
(74) *Attorney, Agent, or Firm* — Law Office of Jesse D. Lambert, LLC

(57) ABSTRACT

A downhole vibratory tool for placement in drillstrings which creates vibration in the drillstring while drilling. A rotary drive rotates in response to fluid flow through it, rotating a rotor having a lower end engaging an upper end of a mandrel. The mandrel is held in a main body such that it is rotationally locked with respect to the main body, but can move longitudinally within a restricted range. The lower end of the rotor and the upper end of the mandrel have interfacing surfaces. Rotation of the rotor and interaction of the interfacing surfaces creates a back-and-forth movement of the mandrel with respect to the rest of the tool, creating the desired vibratory motion.

5 Claims, 6 Drawing Sheets

(56) References Cited

U.S. PATENT DOCUMENTS

| | | | | |
|---|---|---|---|---|
| 10,017,999 | B1 * | 7/2018 | Tinsley, Jr. ..... | E21B 7/046 |
| 2007/0256865 | A1 * | 11/2007 | Cruickshank ..... | E21B 7/067<br>175/61 |
| 2015/0107904 | A1 * | 4/2015 | Kerstetter ..... | E21B 4/02<br>175/57 |
| 2016/0108677 | A1 * | 4/2016 | von Gynz-Rekowski ..... | E21B 4/10<br>175/57 |

* cited by examiner

DOWNHOLE VIBRATORY TOOL FOR PLACEMENT IN DRILLSTRINGS

CROSS REFERENCE TO RELATED APPLICATIONS

This non-provisional United States patent application is a continuation of U.S. non-provisional patent application Ser. No. 14/814,710, and claims priority to United States Provisional patent application Ser. No. 62/033,352, filed Aug. 5, 2014, and 62/111,348, filed Feb. 3, 2015, for all purposes. The disclosure of those provisional patent applications are incorporated herein in their entirety, to the extent not inconsistent with this non-provisional application.

BACKGROUND

Various oil and gas well drilling and servicing operations benefit from inducing vibrations in the drillstring and/or workstring used to conduct the operation, referred to herein as the "drillstring." Examples include horizontal well drilling, in which the vibration induced in the drillstring greatly reduces downhole friction, and permit transfer of drillstring weight to the bit or other downhole device in order to effectively carry out downhole operations.

Various tools currently exist to induce downhole drillstring vibrations. Examples include tools which fundamentally operate by inducing pulses in the drilling fluid stream, by momentarily reducing flow area, then increasing it again. Such "hydraulic" tools generally do not permit passage of any downhole tools through the vibratory tool, because as a function of their mode of operation the bore is partially obstructed; as a result, downhole logging tools, fishing tools or any other type of tool cannot be used below the drillstring depth of the vibratory tool. This and other limitations exist in connection with currently known tool designs.

SUMMARY

A downhole vibratory tool for inducing vibrations in a drillstring, according to the principles of the present invention, comprises a rotating downhole rotor acting on a longitudinally movable mandrel. The mandrel does not rotate relative to the main body of the tool or the drillstring. The rotor is turned by fluid flow, therefore rotating relative to the main body of the tool, the drillstring, and the mandrel, and may operate under principles similar to those in downhole turbines, positive displacement motors, or similar apparatus. The rotor and the mandrel have interfacing surfaces in contact with each other, the interfacing surfaces having shaped profiles effectively forming cam profiles which create a longitudinal, back-and-forth movement between the mandrel and when the rotor rotates relative to the mandrel. As the rotor rotates, the cam surfaces force the mandrel and the main body of the tool apart from one another (in a downhole direction and in an axial direction with respect to the wellbore). While drilling, compression of the drillstring will force the mandrel and the main body of the tool back together. This generates the longitudinal back-and-forth movement of the mandrel relative to the main body of the tool, and generates the vibratory action.

The cam profiles may take a number of different shapes, as long as the shapes result in the desired longitudinal back-and-forth movement of the mandrel, and consequently generate the desired vibration in the drillstring.

Both the rotor and the mandrel have longitudinal bores therethrough, which permit passage of downhole (usually wireline conveyed) tools through the vibratory tool. This permits use of tools such as directional tools, measurement while drilling or MWD tools, or any other desired tool having a diameter small enough to pass through the bore of the vibratory tool components.

Additional attributes of a current, second embodiment of the downhole vibratory tool include:

1) A retrievable flow nozzle, insertable into the inlet (uppermost) end of the bore of the rotor, to create the desired diversion of fluid (flow rate passing through the bore of the flow nozzle and consequently the rotor, vs. flow rate diverted around the outer surface of the rotor). The retrievable flow nozzle has an uphole profile which permits it to be engaged by an appropriate tool (wireline or coiled tubing conveyed) and retrieved. When that is done, the full diameter of the bore of the rotor is available for passage of wireline tools and the like.
2) An improved torque transmission profile between the main body and the mandrel, which has the main body and the mandrel rotationally locked yet permits some degree of longitudinal movement between the main body and the mandrel (necessary for the creation of drillstring vibrations). Preferably, a polygonal spline is used, which may be a generally four sided polygon (e.g. internally mating rounded square cross section shapes), or alternatively may be a three sided polygon. In addition, shoulders between the main body and mandrel prevent the uphole end of the mandrel from contacting any internal shoulder or similar surface within the main body, to avoid end deformation of the mandrel.
3) The mandrel being in a segmented configuration with a first, lower (downhole) and a second, upper (uphole) segment. The first, lower segment comprises the part of the mandrel extending below the main body and typically comprising a threaded connection for making up the vibratory tool into the drillstring. The upper or uphole end of the first segment terminates in a square or generally "flat" upward facing surface. The second, upper segment has a lower or downhole surface which is also generally flat, and engageable with the uphole end of the first segment. The uphole end of the second segment comprises the engaging surface with an appropriate interface shape that engages the corresponding interface shape of the rotor; relative rotation between the rotor and this second segment of the mandrel which creates the axial movement. Axial movement of the second, uphole segment is transferred via the mating flat surfaces (between the first and second mandrel segments) to the first, downhole segment. A second spring means (as noted below) is provided, preferably a nitrogen (or other suitable inert gas) shock, which biases the second segment of the mandrel in an uphole direction. This spring means thereby keeps the engaging surfaces between the rotor and the second mandrel segment in contact at all times, avoiding unsynchronized relative rotation between the rotor and the second mandrel segment.
4) Both the first, lower (downhole) and the second, upper (uphole) mandrel segments are spring biased in an upward (uphole) direction. First and second spring means, preferably a nitrogen (or other suitable inert gas) shock, biases the mandrel segments in an uphole direction, thereby lessening the effect of the mandrel "bottoming out" inside of the main body. As long as the tension force between the mandrel and the main body is less than the force generated by the spring means, then the mandrel is prevented from extending to its maximum outward position. This provides a cushioning effect between the mandrel and the main body.

BRIEF DESCRIPTION OF THE DRAWINGS

FIG. 8 is a cross section view of a section of another embodiment of the vibratory tool, generally an upper section of the vibratory tool.

FIG. 9 is a cross section view a section of another embodiment of the vibratory tool, generally a lower section of the vibratory tool. It is understood that FIGS. 8 and 9 together show the overall length of the tool, generally from the lowermost end of the rotary drive section downhole.

FIG. 10 is a section view along the indicated section lines in FIG. 9.

FIG. 11 is a more detailed view of the retrievable flow nozzle elements of the second embodiment.

DESCRIPTION OF THE PRESENTLY PREFERRED EMBODIMENTS

While a number of embodiments of the invention are possible, all within the scope of the present invention, with reference to the drawings some of the presently preferred embodiments can be described.

It is to be understood that "upper," "upward," "uphole," "lower," "downward," and "downhole" are relative terms, generally referring to the apparatus in its usual orientation in a wellbore, which is the orientation shown in the figures, especially the annotations of "uphole" and "downhole" as made in the figures. "Upward" and "uphole" are generally synonymous; "downward" and "downhole" are generally synonymous. The scope of the invention is not limited by any particular orientation of the apparatus.

Figure 1:
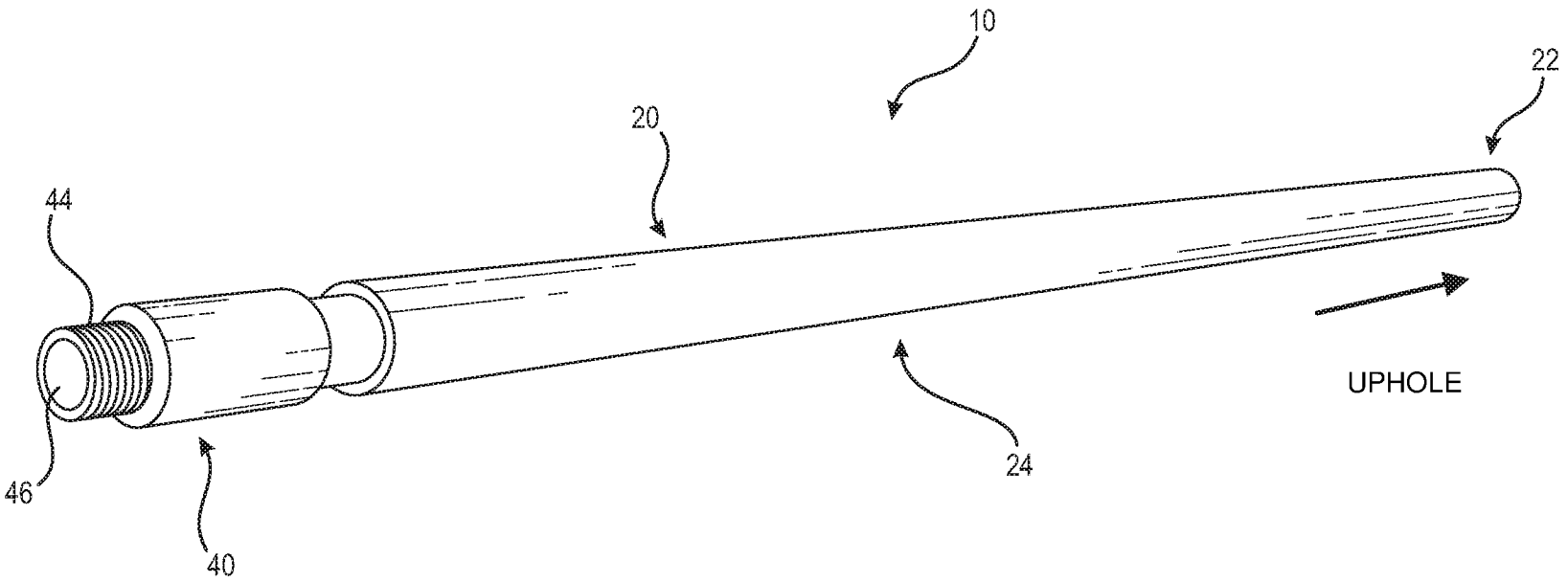
FIG. 1 is a perspective outer view of the vibratory tool.
Figure 2:
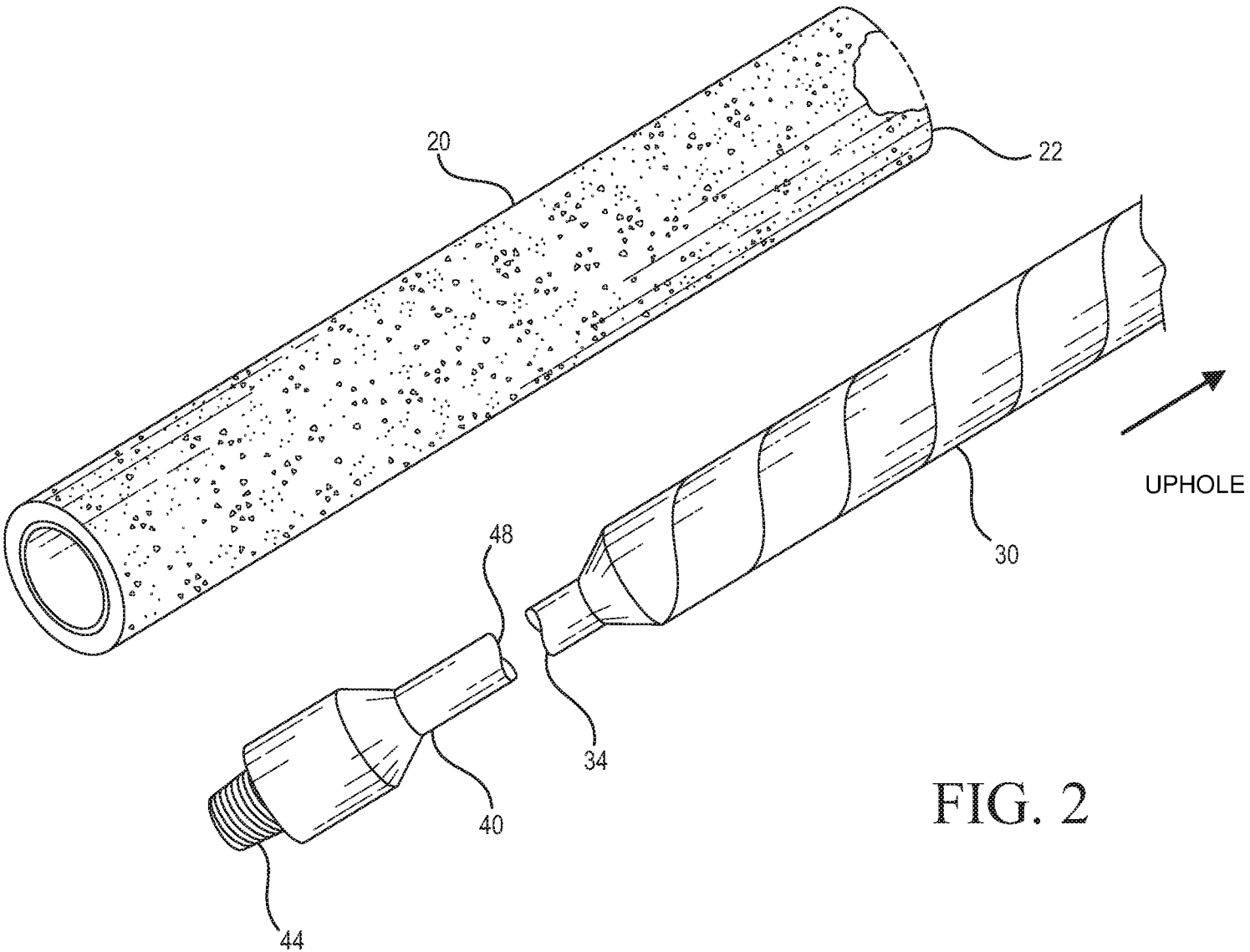
FIG. 2 is an exploded view of one embodiment of certain components of the vibratory tool.
Figure 3:
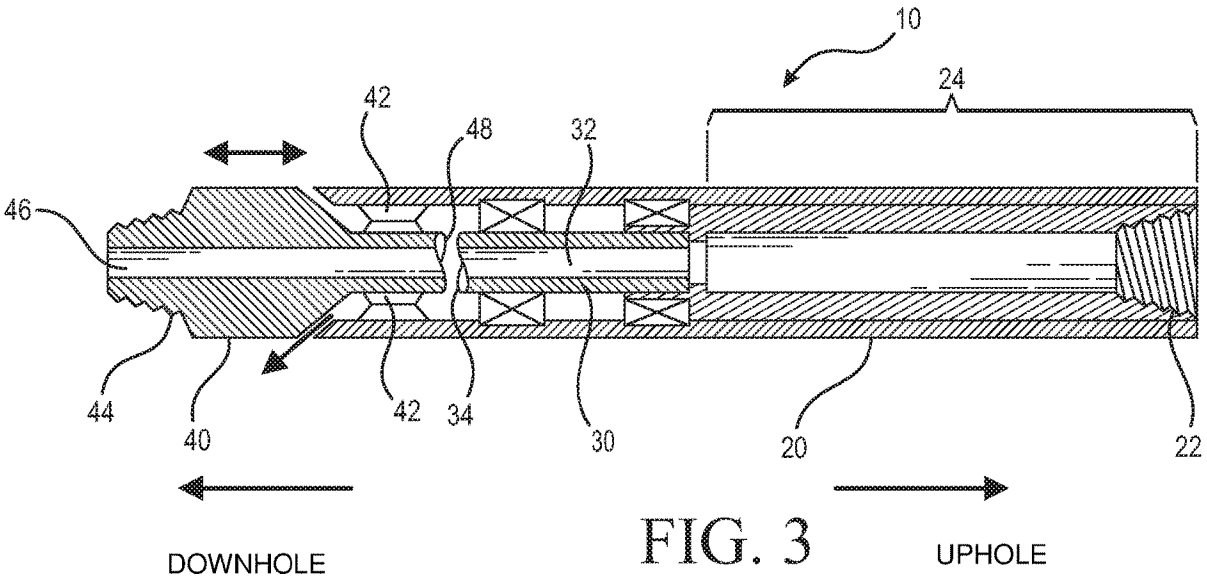
FIG. 3 is a partial cross section view of one embodiment of the vibratory tool.
Figure 4:
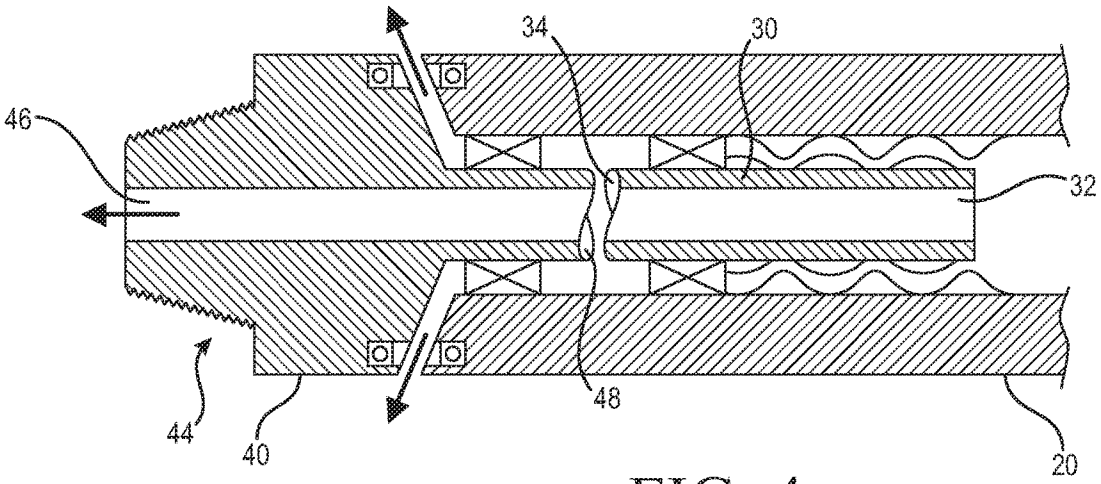
FIG. 4 is another partial cross section view of certain components of the vibratory tool, of the embodiment of FIGS. 1-3.

FIG. 1 is an outer view showing the general configuration of one embodiment of vibratory tool 10. FIG. 2 is a partially exploded perspective view. FIG. 3 is a cross section view. FIG. 4 is another cross section view. Referring to these figures, vibratory tool 10 comprises a hollow main body 20 which contains the various components of the tool. A means for connecting the uphole end of vibratory tool 10 to a drillstring, typically a threaded connection, for example a threaded top sub 22.

A rotor 30 is rotably disposed in main body 20. Rotor 30 is held in main body 20 by bearings, etc. as are known in the art. Generally, rotor 30 has the form of an extended tubular member, with the upper or uphole end of rotor 30 comprising a means for connecting rotor 30 to a rotary drive 24, and the lower or downhole end of rotor 30 terminating in an end having a desired profile shape, namely an interfacing surface 34. It is understood that this profile shape is something other than a simple square-cut face. Rotor 30 cannot move longitudinally relative to main body 20, only rotate. Rotor 30 has a longitudinal bore 32 therethrough. While FIGS. 2 and 4 show rotor 30 tapering down to a reduced diameter cam surface 34 (with similar shape to mandrel 40 and its surface 48), it is to be understood that such configuration represents only one embodiment, and in fact the diameters of rotor 30 and mandrel 40 can be largely uniform, as in FIGS. 3 (and 5-7). This larger diameter will permit a larger bore and larger bearing area, improving fluid flow and mechanical wear attributes.

The rotary drive 24 may take various forms, all of which provide the fundamental function of rotating rotor 30. For example, rotary drive 24 may be a downhole turbine, which generates rotation in a rotary drive means by passage of drilling fluid over a series of vanes, as is well known in the relevant art. Rotary drive 24 may also comprise a positive displacement motor, commonly known as a "mud motor," typically having a spiral drive rotor turning inside a contoured resilient material stator, as is known in the art. Other drive means may be possible within the scope of the invention, operated by fluid passage. Suitable drive means would all have a through bore to permit passage of downhole tools. Rotary drive 24 is not shown in detail, as those having skill in the relevant art will understand its function and various apparatus are suitable for use.

Mandrel 40 is connected to main body 20 by bearings, retaining means, etc. known in the art. Mandrel 40 is connected to main body 20 in a manner that it can move a short distance longitudinally, for example 1", yet cannot rotate relative to main body 20. One suitable manner of achieving this connection (that is, permitting limited relative longitudinal movement, yet no relative rotation, both with respect to the main body) would be by the use of splines 42, as can be seen in FIG. 3. Other manners of connection are possible and contemplated within the scope of this invention. As can be seen in FIGS. 3 and 4, when mandrel 40 is in its outwardly extended position, a certain volume of fluid may flow between mandrel 40 and main body 20. It is to be understood that the tool can be configured so as to either permit this bypass flow, or to cause the entirety of the fluid flow to flow through the tool or pass all the fluid through the vibratory tool to the drillstring components below (downhole of) vibratory tool 10.

Mandrel 40 preferably has a means for connecting mandrel 40 (and consequently main body 20) to the drillstring, at its lower or downhole end. Typically, such means would comprise a threaded connection 44, as seen in FIG. 1-4.

Mandrel 40 has a longitudinal bore 46 therethrough to permit passage of downhole tools and drilling fluids.

As previously noted, mandrel 40 (more particularly, its upper or uphole end), and rotor 30 (more particularly, its lower or downhole end) have interfacing surfaces 48 and 34 respectively. When in operation, these surfaces are in contact with one another, and when drilling fluid is being pumped, rotor 30 is rotating (driven by rotary drive section 24) while mandrel 40 is not rotating, creating relative rotation between rotor 30 and mandrel 40. As previously noted, both of these surfaces comprise some shape that is not a simple square-cut end, but instead comprise interfacing surfaces by which rotation of rotor 30 effectively moves surface 34 as a cam on mandrel surface 48, and with rotor 30 not moving longitudinally relative to main body 20 such movement forces mandrel 40 longitudinally outward (that is, in a downhole direction) from main body 20. Compression forces in the drillstring tend to push mandrel 40 back into main body 20, and do push mandrel 40 back into main body 20 when the interface profiles permit, this action creating the in-and-out movement of mandrel 40 with respect to main body 20 and creating the desired vibratory function. While FIGS. 2-4 show a space or gap between surfaces 34 and 48, this is for illustrative purposes, and during operation the surfaces are usually always in contact with each other.

Figure 7:
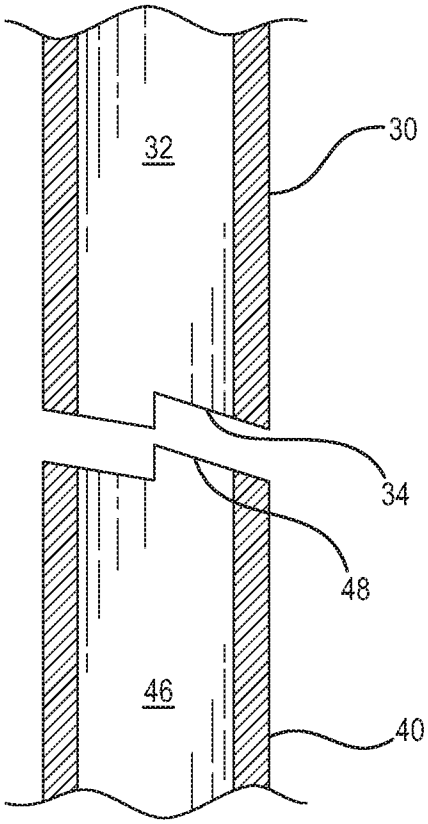
FIGS. 5-7 show alternate, non-exclusive embodiments of the interfacing surfaces (cam surfaces or cam profiles) between the rotor and mandrel of the vibratory tool.
Figure 6:
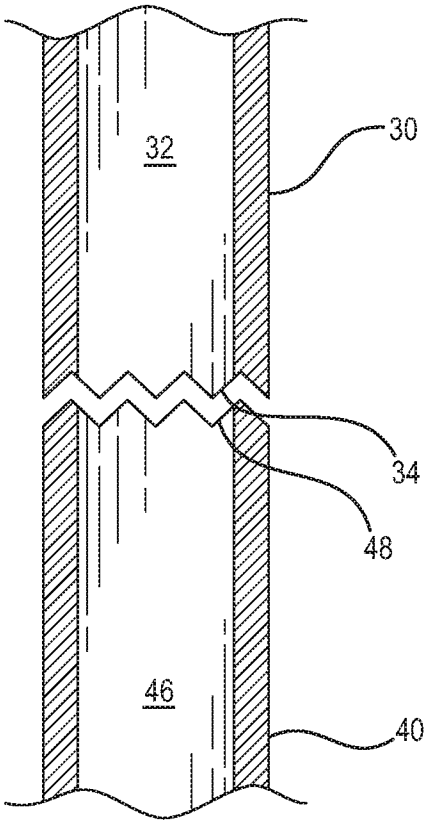
Figure 5:
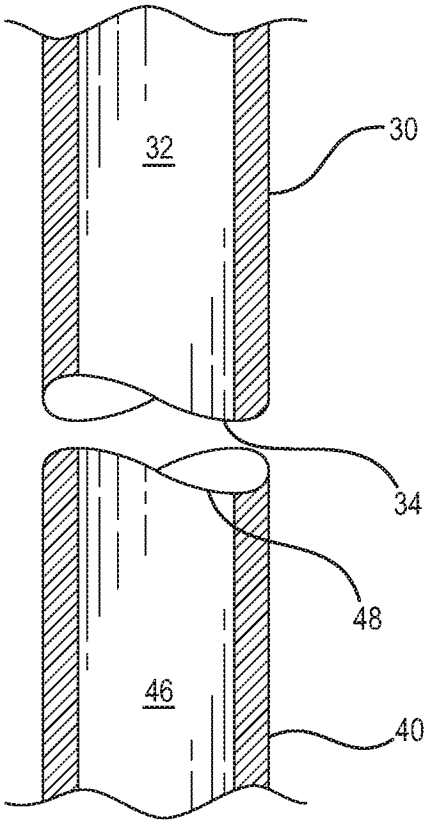

A number of interface shapes, that is, the respective shapes of the engaging surfaces 34 and 48 on the ends of rotor 30 and mandrel 40, are possible. Non-exclusive examples are shown in FIGS. 5-7. FIG. 5 shows a profile resembling an oscillating wave. FIG. 6 shows a profile resembling a modified sawtooth. FIG. 7 shows a profile resembling a ramp section with a drop off section. It is understood that many other interfacing surface (cam profile) shape combinations are possible, as long as they produce the desired movement of the mandrel with respect to the main body, and therefore the desired vibratory movement.

Use of the Vibratory Tool

The vibratory tool is made up into the drillstring so as to place it at a desired downhole location. The drillstring is then lowered into the borehole in preparation for drilling or other operations.

It is understood that mandrel 40 and rotor 30 have appropriate and desired interfacing surfaces or cam profiles, to generate the desired vibratory action.

Assuming that a drilling operation is taking place, the drillstring is lowered until a desired weight on bit ("WOB") has been achieved. It is understood that most or all of the drillstring, including the location of the vibratory tool, is in compression, thereby tending to force mandrel 40 into main body 20. When fluid circulation starts (that is, pumping drilling or other fluids down the drillstring, and through vibratory tool 10 and the other drillstring components) rotary drive section 24 rotates rotor 30. The rotation of rotor 30 causes the cam profiles to rotate relative to one another, thereby forcing mandrel 40 out of main body 20, then permitting it to move back into main body 20 when the profiles permit. Whether mandrel 40 moves out from main body 20, or whether main body 20 (and the drillstring above it) is moved upwardly slightly (that is, in an uphole direction), it can be appreciated that the result is an alternate lengthening and shortening of the overall assembly, thereby creating the desired vibratory action. Fluid flow rates, WOB, and other operating parameters are adjusted as known in the art. Suitable cam profiles are selected so as to yield the desired vibratory action. Some portion of the total fluid flow tends to bypass mandrel 40 and flow outwardly around and between mandrel 40 and main body 20, as can be seen in FIGS. 3 and 4.

It is understood that the longitudinal bores 32 and 46 through rotor 30 and mandrel 40 permit passage of downhole tools, if needed.

Materials, Dimensions, Fabrication

Materials suitable for use in fabrication of the vibratory tool are those well known in the relevant art, for example high strength steel alloys and resilient materials as needed for seals, etc. Dimensions may be modified to suit any particular application. Methods of fabrication are well known in the relevant industry.

A Second Embodiment of the Vibratory Tool

Figure 8:
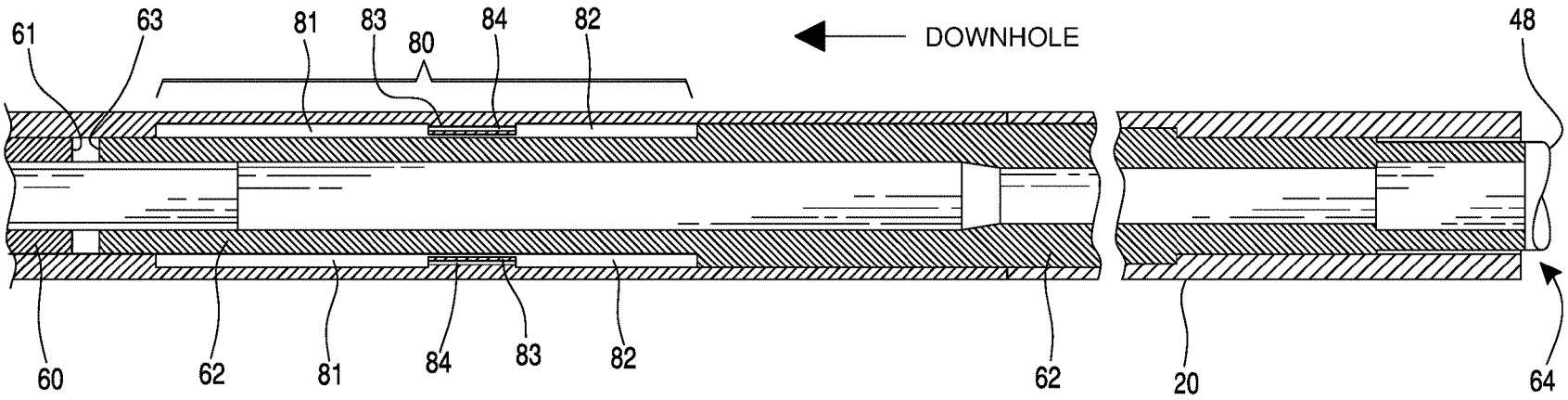
FIGS. 8-11 show various views of a second embodiment of a vibratory tool embodying the principles of the present invention. For clarity, the overall vibratory tool drawing is broken into two drawings. More specifically.
Figure 9:
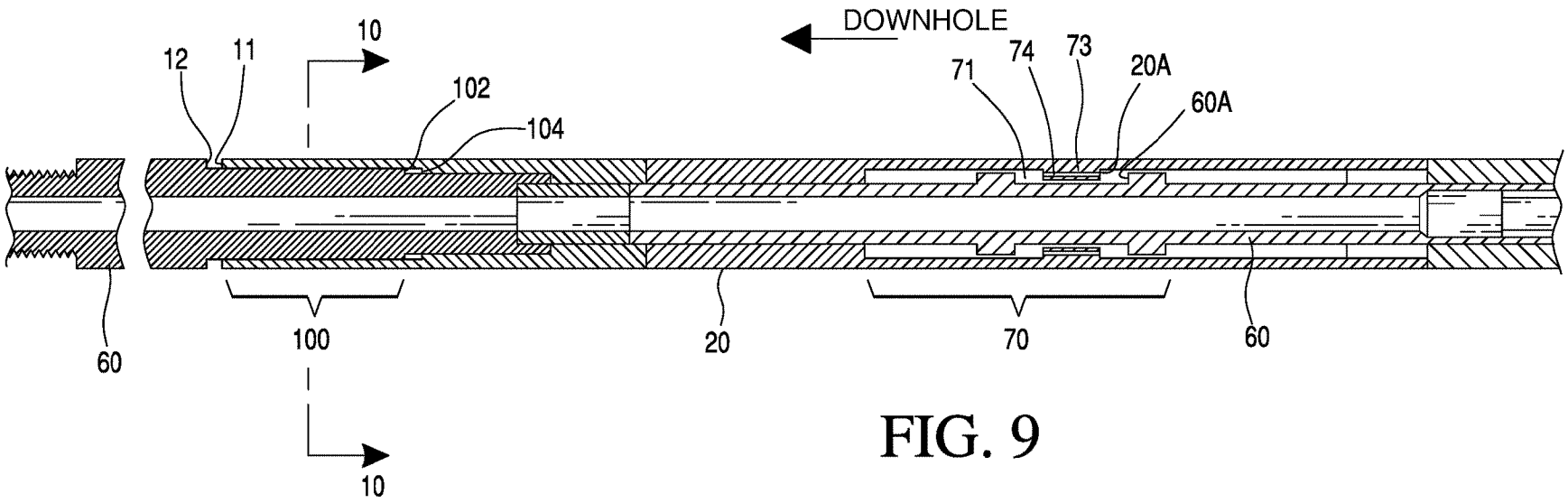
Figure 11:
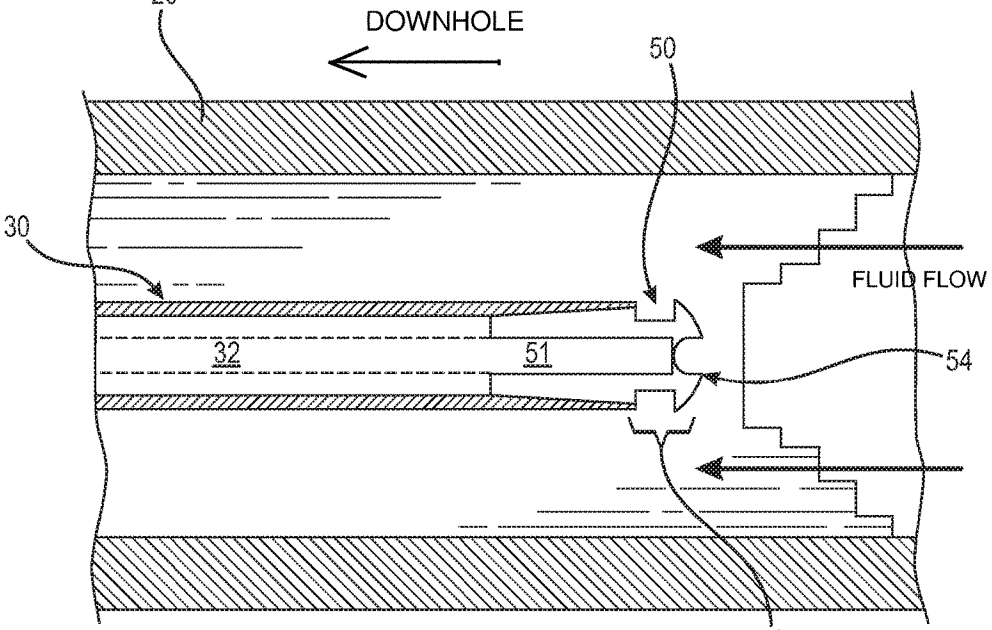
Figure 10:
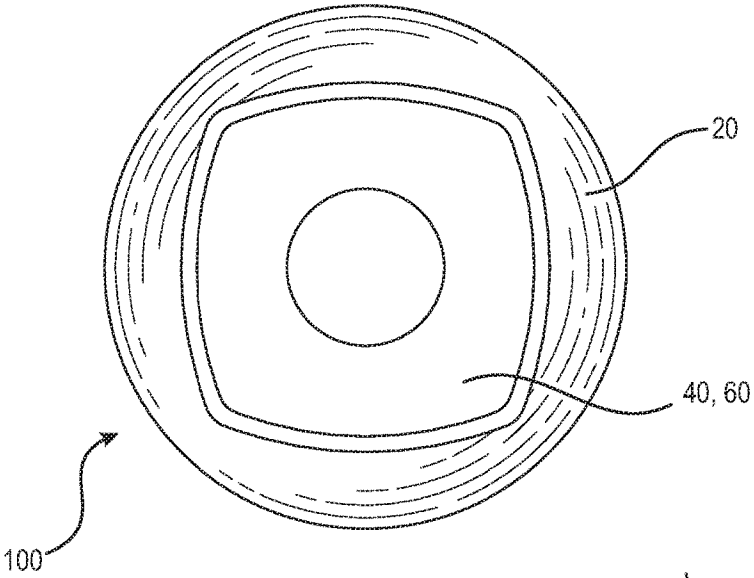

With reference to FIGS. 8-11, additional attributes of a second embodiment of the downhole vibratory tool can be described. With reference to FIGS. 8-10: FIG. 8 shows a general view of the upper (uphole) section of the vibratory tool (that is, the section downhole from the rotary drive or turbine section) and the upper mandrel segment, while FIG. 9 shows a cross section of the lower (downhole) section of the vibratory tool, including the lower mandrel segment. FIG. 11 is a view of the upper end of the rotary drive (turbine) section.

Retrievable Flow Nozzle

Total drilling fluid flow down the drillstring is preferably divided to allow a portion to flow through the bore of the rotor, and downhole through the respective bores of the remaining drillstring components; and the remainder to flow around the outer surface of the rotor, thus generating the desired rotor rotation. To create the desired flow split for normal rotor function (and normal vibratory tool usage), a relatively small flow area for fluid flow through the rotor bore is desirable. However, that relatively small bore prevents passage of any tools through the bore of the rotor.

This second embodiment addresses that issue with a retrievable jet nozzle disposed in the bore of the rotor. As can be seen in in more detail in FIG. 11, a retrievable flow nozzle 50 is insertable into the inlet (uppermost) end of the bore 32 of rotor 30, to create the desired diversion of fluid (flow rate passing through bore 51 of flow nozzle 50 and consequently bore 32 of rotor 30, vs. flow rate diverted around the outer surface of rotor 30). Retrievable flow nozzle 50 has an uphole profile 52 which permits it to be engaged by a surface deployed, appropriate tool (wireline or coiled tubing conveyed) and retrieved. When that is done, the full diameter of the bore of rotor 30 is available for passage of wireline tools and the like. In a presently preferred embodiment, retrievable flow nozzle 50 has a self-centering/locking taper as seen in FIG. 11, which fits into a mating taper in bore 32 in uphole end of rotor 30. Flow nozzle 50 has a bore 51 therethrough and a jet 54 disposed in the bore, to permit adjustment of the flow area through bore 51 of flow nozzle 50. An uphole profile 52, or "fishing neck," is preferably provided on flow nozzle 50, to permit retrieval of flow nozzle 50 while the vibratory tool 10 remains downhole, by wireline, coiled tubing or other suitable means. It can be appreciated that flow nozzle 50 can be re-installed if desired by similar means, while the vibratory tool remains downhole.

Segmented Mandrel

In this embodiment, mandrel 40 is in a segmented configuration with a first or lower and a second or upper segment. With reference to FIGS. 8 and 9, the first, lower segment 60 comprises that part of mandrel 60 extending below main body 20 and typically comprising a threaded connection for making up the vibratory tool into the drillstring. The upper or uphole end 61 of first segment 60 terminates in a square or generally "flat" upward facing surface. The second, upper segment 62 has a lower or downhole surface 63 which is also generally flat, and engageable with uphole end 61 of first segment 60. The uphole end 64 of second segment 62 comprises the engaging surface 48 with an appropriate interface shape that engages the corresponding interface shape and engaging surface 34 of rotor 30; relative rotation between rotor 30 and this second segment 62 of the mandrel which creates the axial movement. Axial movement of second segment 62 is transferred via the mating flat surfaces 61 and 63 (between the first and second mandrel segments 60 and 62) to first segment 60.

This embodiment of vibratory tool 10 comprises first and second spring means 70 and 80 respectively, to bias mandrel first segment 60 (of mandrel 40) and second segment 62 (of mandrel 40), both in an uphole direction, as will be described. Further, first and second spring means 70 and 80 also provide a dampening effect on movement of these elements.

First spring means 70, preferably a nitrogen (or other suitable inert gas) shock, biases first segment 60 of mandrel 40 in an uphole direction, thereby lessening the effect of the mandrel "bottoming out" inside of the main body, when first (lower) segment 60 is (in effect) pulled from main body 20. As long as the tension force between the mandrel and the main body is less than the force generated by first spring means 70, then first segment 60 is prevented from extending to its maximum outward position (that is, fully extended from main body 20). This provides a cushioning effect between first segment 60 and main body 20. FIG. 8 shows the tool in its fully extended position. First spring means 70 comprises dual chambers 71 and 72 (chamber 72 not shown due to the position of first segment 60), separated by a shoulder 73, through which longitudinal passages run. As first segment 60 moves back and forth within main body 20, it can be appreciated that gas is forced back and forth through the passages. Since the flow area through the passages is relatively small, the resistance to flow provides the desired cushioning effect. In FIG. 9, as noted above, first segment 60 is in its extended position, hence a shoulder 60A on first segment 60 butts up against a corresponding shoulder 20A within main body, preventing any further extension of first segment 60.

Also, due to the position of first segment 60 (in its extended position), a gap exists between first segment 60 and second segment 62, as noted in FIG. 8. When the tool is on bottom and drilling, compressive forces move first segment 60 back up so as to cause first and second segments to come into contact.

A second spring means 80 is also provided, similar to first spring means 70, which biases second (upper) segment 62 of the mandrel in an uphole direction. Second spring means 80 thereby keeps the engaging surfaces 48 and 34 between rotor 30 and the second segment 62 in contact at all times, avoiding unsynchronized relative rotation between the rotor and the second mandrel segment. Second spring means 80 also comprises dual chambers 81 and 82, separated by a shoulder 83, through which passages run.

Torque Transmission Profile (Spline) Between the Main Body and the Lower Mandrel Segment The second embodiment of the vibratory tool preferably comprises an improved torque transmission profile (spline) between main body 20 and first (lower) mandrel segment 60, the spline keeping main body 20 and first segment 60 rotationally locked yet permitting a desired amount of longitudinal movement between the main body and the lower mandrel segment (necessary for the creation of drillstring vibrations).

As can be seen in FIG. 9, first segment 60 is disposed within main body 20, and rotationally locked thereto. FIG. 10 is a section view along the section lines indicated in FIG. 9. Preferably, a polygonal spline 100 is used, which may be a generally four sided polygon (e.g. internally mating rounded square cross section shapes, as shown in FIG. 10), or alternatively may be a three sided polygon, or any other suitable number of sides.

In addition, as can be seen in FIG. 9, shoulders 11 and 12 between main body 20 and first segment 60, respectively, come into contact before a shoulder 102 on the uphole end of spline 100 contacts internal shoulder 104 within main body 20, thus avoiding end deformation of the spline 100.

CONCLUSION

While the foregoing description has given a number of details regarding the structure and operation of the vibratory downhole tool, same are given by way of example only and not limitation. Many changes are possible within the scope of the present invention.

Therefore, the scope of the present invention is not to be limited by the exemplary description herein, but by the appended claims and their legal equivalents.

We claim:

1. An apparatus for creating vibrations downhole in a drillstring, comprising:

an elongated main body having a longitudinal bore;

a mandrel disposed in said longitudinal bore of said main body, said mandrel and said main body connected by a spline connection with said main body which permits limited longitudinal movement between said main body and said mandrel but which has said mandrel rotationally locked to said main body, said mandrel comprising a longitudinal bore, an uphole end of said mandrel comprising an upward facing interfacing surface; and a rotor rotatably disposed in said longitudinal bore of said main body, having a downward facing interfacing surface in contact with said interfacing surface of said mandrel, said rotor comprising a longitudinal bore, said rotor longitudinally fixed within said main body, wherein rotation of said rotor results in rotation of said interfacing surface of said rotor on said interfacing surface of said mandrel, each of said interfacing surfaces comprising shapes, the shapes of said interfacing surfaces resulting in back-and-forth longitudinal movement of said mandrel with respect to said main body.

2. The apparatus of claim 1, further comprising a rotary drive connected to said rotor and generating rotation of said rotor in response to fluid flow through said apparatus.

3. The apparatus of claim 2, further comprising a retrievable flow nozzle disposed in said bore of said rotor, said retrievable flow nozzle comprising a bore and a jet disposed in said bore, said retrievable flow nozzle comprising a profile on its the uphole end thereof and adapted to gripping by a surface-deployed tool, for retrieval of said flow nozzle.

4. The apparatus of claim 3, wherein said retrievable flow nozzle comprises a tapering cross section shape which engages a mating tapering shape in said bore of said rotor.

5. The apparatus of claim 4, wherein said spline comprises mating sections of said mandrel and said housing, wherein a cross section shape of said sections comprises a quadrilateral having arcuate sides.

* * * * *